US010344492B2

(12) United States Patent
Epple

(10) Patent No.: US 10,344,492 B2
(45) Date of Patent: Jul. 9, 2019

(54) FLEXIBLE TOP CAP FOR A POOL

(71) Applicant: Trivector Manufacturing Inc., Fort Wayne, IN (US)

(72) Inventor: Thomas A. Epple, Traverse City, MI (US)

(73) Assignee: Trivector Manufacturing Inc., Fort Wayne, IN (US)

( * ) Notice: Subject to any disclaimer, the term of this patent is extended or adjusted under 35 U.S.C. 154(b) by 0 days.

(21) Appl. No.: 15/820,831

(22) Filed: Nov. 22, 2017

(65) Prior Publication Data

US 2018/0142485 A1 May 24, 2018

Related U.S. Application Data

(60) Provisional application No. 62/425,310, filed on Nov. 22, 2016.

(51) Int. Cl.
*E04H 4/14* (2006.01)

(52) U.S. Cl.
CPC ..... *E04H 4/14* (2013.01); *E04H 4/142* (2013.01)

(58) Field of Classification Search
CPC ..... E04H 4/14; E04H 1/141; E04H 2004/146; E04H 2004/147; E04H 4/142
USPC ..... 4/506
See application file for complete search history.

(56) References Cited

U.S. PATENT DOCUMENTS

| | | | | |
|---|---|---|---|---|
| 3,524,291 | A * | 8/1970 | Rozanski | E04H 4/141 4/506 |
| 4,158,244 | A * | 6/1979 | Stefan | E04H 4/142 4/506 |
| 4,167,084 | A * | 9/1979 | Brunton | E04H 4/0043 4/506 |
| 4,901,492 | A * | 2/1990 | Coates | E04H 4/14 4/506 |
| 2003/0000166 | A1 * | 1/2003 | Arignon | E04H 4/141 4/506 |
| 2003/0009822 | A1 * | 1/2003 | Coates | E04H 4/141 4/506 |

* cited by examiner

*Primary Examiner* — Tuan N Nguyen
(74) *Attorney, Agent, or Firm* — Taylor IP, P.C.

(57) ABSTRACT

A pool including a wall having a top end and a wall profile, and a reinforcing system for reinforcing the wall. The reinforcing system includes a plurality of top caps attached to the top end of the wall. Each top cap includes a shell body with a peripheral surface and at least one internal truss member such that each top cap is laterally flexible.

18 Claims, 5 Drawing Sheets

FLEXIBLE TOP CAP FOR A POOL

CROSS REFERENCE TO RELATED APPLICATIONS

This is a non-provisional application based upon U.S. provisional patent application Ser. No. 62/425,310, entitled "FLEXIBLE TOP CAP FOR A POOL", filed Nov. 22, 2016, which is incorporated herein by reference.

BACKGROUND OF THE INVENTION

1. Field of the Invention

The present invention relates to the construction of on-ground swimming pools, and more particularly, to a pool retaining wall reinforcing and support system having a flexible top cap.

2. Description of the Related Art

On ground pools, also known as partially or semi in ground pools, are generally constructed from a bottom floor section, a retaining wall, and a pool liner in order to create a reservoir and hold water therein. The defining feature of on ground pools is that they may be at least partially buried in the ground, for example at a depth ranging from a few inches to almost the complete height of the retaining walls of the on ground pools. On ground pools can be adapted to a variety of terrains, such as sloping hills, because the retaining wall may be buried at varying depths. Unlike in ground pools, on ground pools do not necessitate a concrete walkway around the perimeter of the pool, and thereby on ground pools may be fitted with various types of surrounding walkways, patios, decks, etc.

The design of on ground pools can be limited due to the structural support members reinforcing the retaining wall. Some on ground pools may have a retaining wall that is buttressed by multiple vertical beams on the outer perimeter of the retaining wall. Also, some on ground pools may have a retaining wall with a top surface or upward-facing flange that is reinforced by top rail sections. These top rail sections generally match the shape of the wall and cover the entire perimeter of the pool. Top rail sections may be in the form of panels with a uniform shape, for example a rectangular shape. If the pool has a curved profile, then the top rail sections may be bent to match the profile of the pool retaining wall. Hence, the shape of on ground pools may be limited to simple configurations, e.g. rectangles or polygons, because of how the retaining wall is reinforced by the vertical supports and top rail sections.

Generally, the paramount advantage of an on ground pool compared to an in ground pool is that the installation of an on ground pool costs significantly less than the installation of an in ground pool, due to the more simplistic installation process of the on ground pool. However, even though on ground pools have the advantage of cost-savings, the cost of construction of some on ground pools can be inflated. If a particular on ground pool has a complex design, it typically requires an increased number of parts and a more intensive assembly process, which ultimately increases the overall cost of construction. For instance, to reinforce the complex design of a retaining wall, a greater number of rail sections must be used, bent to follow the complex design of the retaining wall, and installed on the retaining wall. Further, the assembly process of such an on ground pool can be more toilsome and potentially impossible for a single person to construct because of the numerous rail sections. Thereby, the construction process may necessitate a multi-person crew, which in turn inflates the overall assembly cost as well.

What is needed in the art is an economical reinforcing and support system for an on ground or above ground pool that allows for numerous design possibilities.

SUMMARY OF THE INVENTION

The present invention provides a reinforcing and support system for an above ground or on ground pool that has flexible top caps which are both flexible to accommodate multiple pool designs and non-compressible to provide structural support for the retaining wall. Each flexible top cap includes a shell body with an outer periphery and an internal truss structure. The reinforcing and support system of the present invention can aptly reinforce advanced contours and decrease the overall construction cost.

The present invention in one form is directed to a pool including a support wall having a top end and a wall profile, and a reinforcing system for reinforcing the support wall. The reinforcing system includes a plurality of top caps attached to the top end of the support wall. Each top cap includes a shell body with a peripheral surface and at least one internal truss member such that each top cap is laterally flexible.

The present invention in another form is directed to a reinforcing system for a pool having a wall with a top end and a wall profile. The reinforcing system includes a plurality of top caps configured for attaching to the top end of the wall. Each top cap includes a shell body with a peripheral surface and at least one internal truss member such that each top cap is laterally flexible.

The present invention in yet another form is directed to a method for reinforcing a pool with a wall having a top end and a wall profile. The method includes the steps of providing a reinforcing system configured for reinforcing the wall. The reinforcing system includes a plurality of top caps configured for attaching to the top end of the wall. Each top cap includes a shell body with a peripheral surface and at least one internal truss member such that each top cap is laterally flexible. The method includes the further steps of flexing at least one top cap of the plurality of top caps for following the wall profile of the wall, and attaching the plurality of top caps to the wall of the pool.

An advantage of the present invention is that more complex and advanced design contours can be achieved, resulting in a more aesthetically pleasing above ground or on ground pool.

Another advantage of the present invention is that the assembly process is streamlined and made easier as there are fewer parts involved in reinforcing and supporting the retaining wall of the pool.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DESCRIPTION OF THE INVENTION

Figure 1:
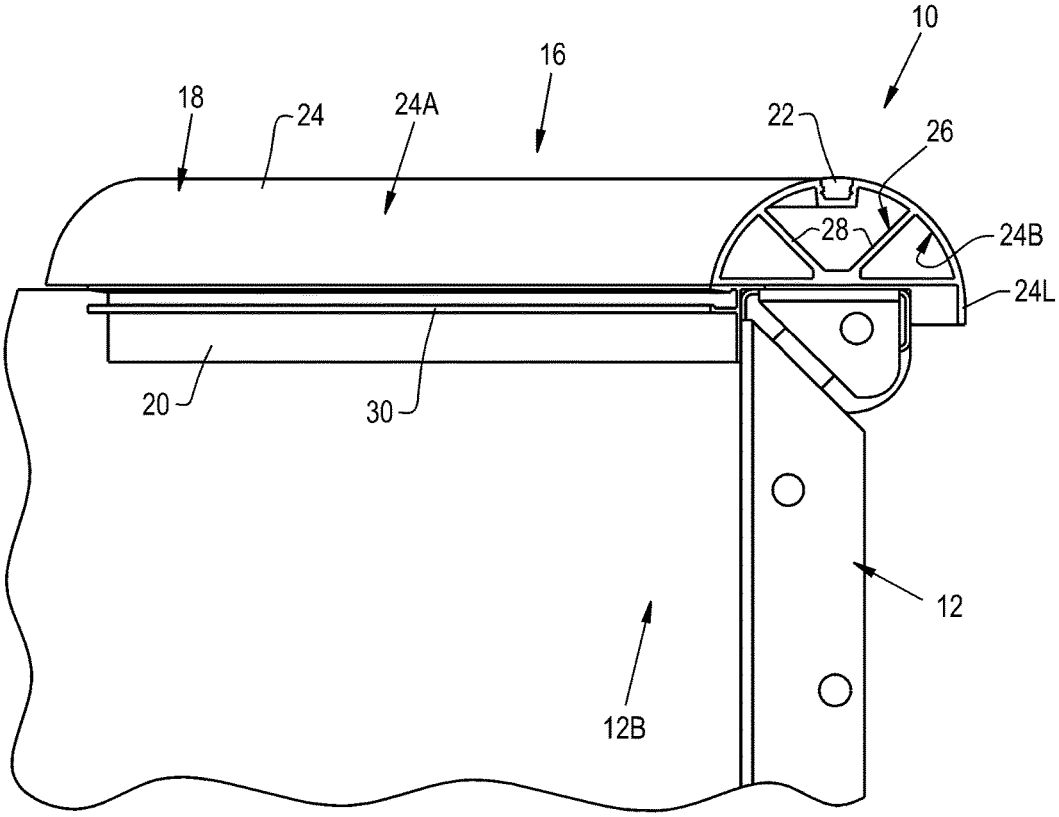
FIG. 1 is a side perspective view of a retaining wall reinforcing system having a top cap and an insert according to the present invention.

Referring now to FIGS. 1-4, there is shown a pool 10 with a retaining or support wall 12, a pool liner 14, and a reinforcing and support system 16 for reinforcing or otherwise protecting the support wall 12. The pool 10 may be in the form of any desired pool such as an above ground pool, or an on ground pool 10 which is at least partially buried in the ground. The pool 10 may have a single continuous support wall 12 or a support wall 12 made of multiple support wall sections. The support wall 12 has a top end 12A, e.g., a top flange 12A, an inwardly facing surface 12B, an exterior, outwardly facing surface 12C, and a wall profile such as straight and/or curved. The reinforcing system 16 may generally include one or more top cap(s) 18, a pool liner support member 20, and an insert 22.

Figure 2:
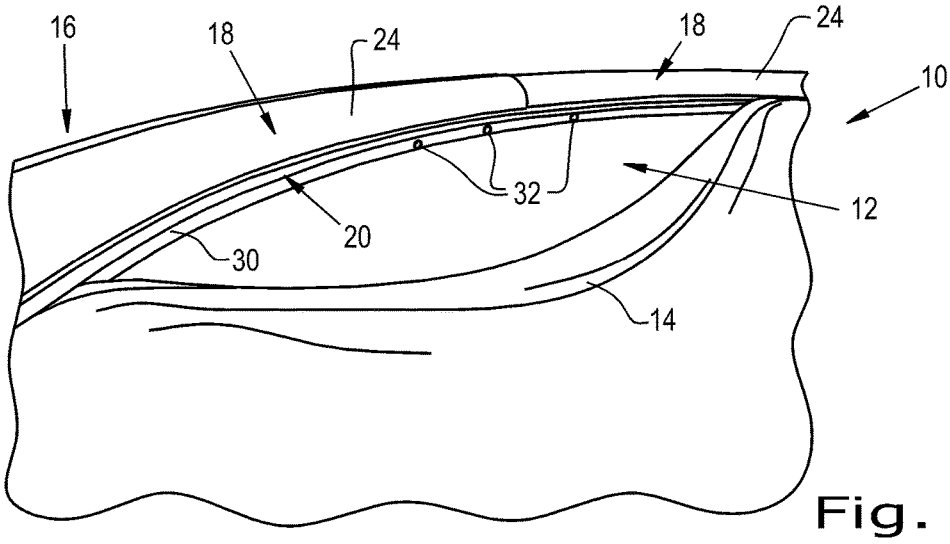
FIG. 2 is a perspective view of the retaining wall reinforcing system mounted to a pool with a curved retaining wall and a pool liner according to the present invention.
Figure 3:
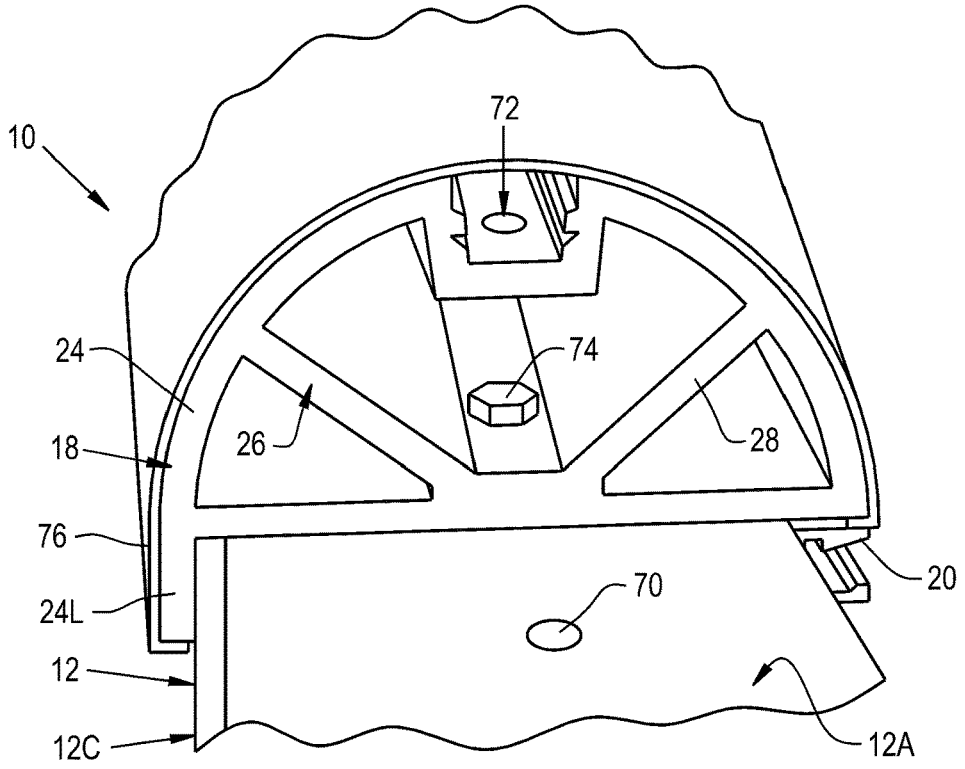
FIG. 3 is a perspective view of an end of the top cap mounted to the retaining wall of the pool.
Figure 5A:
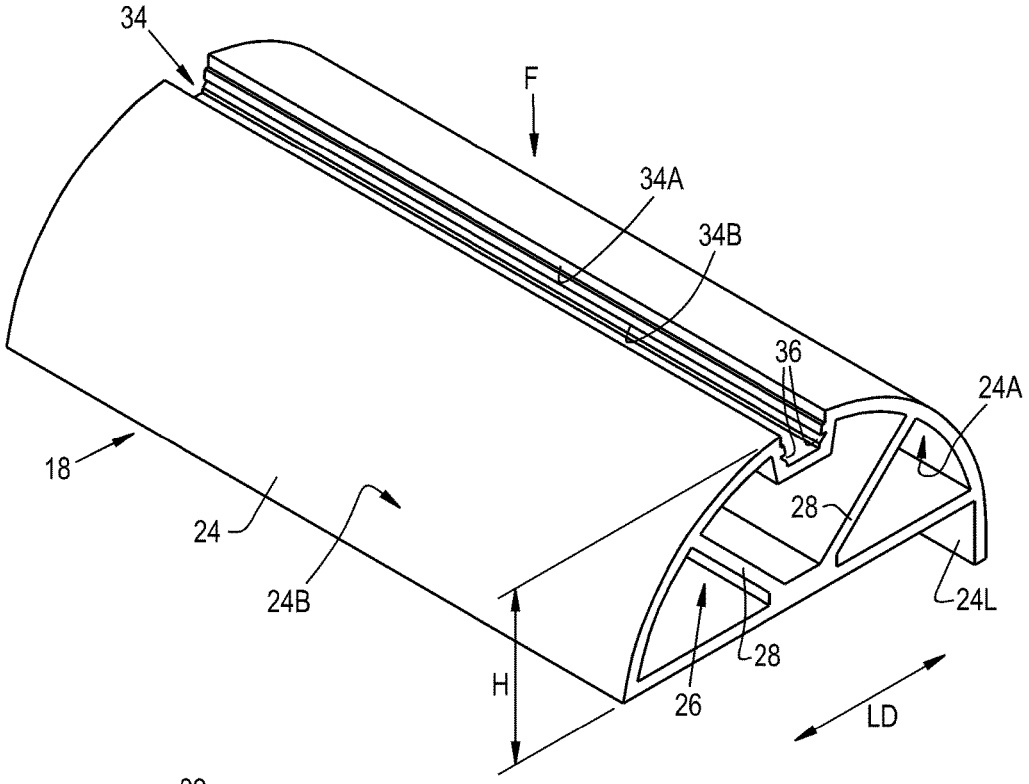
FIG. 5A is a perspective view illustrating an embodiment of the top cap of the present invention.
Figure 5B:
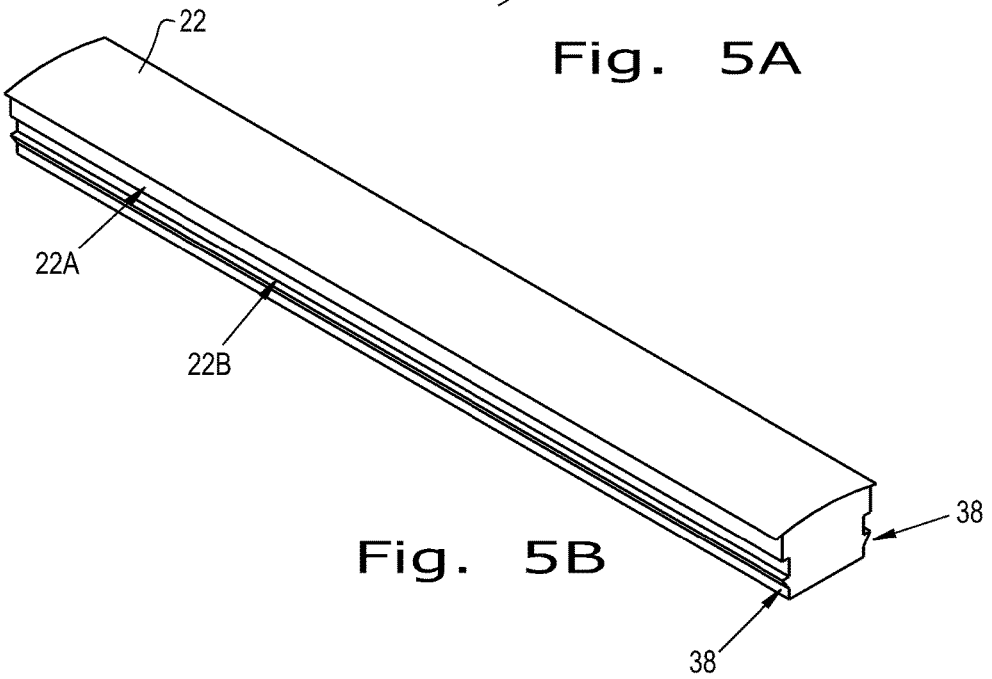
FIG. 5B is a perspective view of an insert according to the present invention.

The top caps 18 are attached to the top flange 12A, of the support wall 12. The top caps 18 cover and support the support wall 12. Each top cap 18 generally includes a shell body 24 with an inner surface 24A, a peripheral surface 24B, an outer lip portion 24L, and an internal truss structure 26 such that the top caps 18 are flexible. For example, the top caps 18 may be laterally flexible in a lateral direction, denoted by arrow LD (FIG. 5A). Thereby, the flexibility of the top caps 18 allows the top caps 18 to accommodate various straight and/or curved portions of the support wall 12. Each top cap 18 may substantially cover the width of the support wall 12 and/or extend beyond the inner and outer surfaces 12B, 12C of the support wall 12, as shown in FIGS. 2-3.

The bottom of the shell body 24 attaches to the top flange 12A of the retaining wall 12. The shell body 24 may be in the form of a semi-circle in which the peripheral surface 24B is curved. However, the shell body 24 may be in the form of various other shapes including rectangles, triangles, semi-hexagons, etc. The shell body 24 may be made from a semi-deformable material, e.g. a flexible plastic or a composite material, such that the top caps 18 are both laterally flexible for following the wall profile of the support wall 12 and non-collapsible for reinforcing the support wall 12. In other words, the top caps 18 may bend from side to side in the lateral direction LD, and the top caps 18 may not significantly translate downwardly under a downwardly acting force F (FIG. 5A). For instance, the top caps 18 will not collapse under a force exerted on the peripheral surface 24B by a user stepping onto the top caps 18 and into the pool 10. It is noted that the term "collapse" as used herein denotes a downward deformation which compresses the shell body 18 to more than approximately a third of its overall height H, and thereby the term "non-collapsible" denotes how the shell body 18 does not deform or otherwise translate downwardly to more than approximately a third of its overall height H.

If the shell body 24 is composed of a plastic material, the plastic used may have a durometer reading between a range of 90-100, for example 95±3. The plastic material used may be a thermoplastic polymer, such as the Dupont™ Hytrel® TPC-ET thermoplastic elastomer. In the present embodiment, the widths of the shell body 24 and the internal truss members 26 is approximately 0.125"; however, the width of the shell body 24 and the width of the internal truss members 26 may vary between 0.0625-0.25". The width of the internal truss members 26 may match or differ the width of the shell body 24. Also, the width of the shell body 24 and/or the internal truss members 26 may vary depending upon the plastic or composite material being used.

The outer lip portion 24L of the top cap 18 extends downwardly beyond the bottom surface of the shell body 24, i.e., downwardly past the top flange 12A of the support wall 12, and adjacent to the outer surface 12C of the support wall 12. The outer lip portion 24L may directly contact the outer surface 12C of the support wall 12, or a gap may exist between the outer surface 12 and the outer lip portion 24L. It should be appreciated that the outer lip portion 24L may be monolithically formed with the shell body 24, or the outer lip portion 24L may be a separate piece which couples to the shell body 24 of the top cap 18.

The internal truss structure 26, e.g. an internal ribbing structure, may include one or more truss or rib member(s) 28 to provide additional support for the shell body 24. In the present embodiment there are two truss members 28; however, it is conceivable to use more than two truss members 28. As shown, the widths of each truss member 28 have substantially the same width of the shell body 24; however, the truss members 28 may have a thinner or thicker width than the shell body 24. The truss members 28 may extend the full length or intermittently at set intervals throughout the shell body 24. The internal truss structure 26 may be monolithically formed with the shell body 24. Alternatively, it is conceivable that the internal truss structure 26 may have a differing plastic composition, for example a more rigid plastic material, or the internal truss structure 26 may be composed of a different material than the material of the shell body 24.

The pool liner support member 20 may be attached to the inner surface 12B of the support wall 12. The pool liner support member 20 may be configured for attaching and supporting the pool liner 14 of the pool 12. The pool liner support member 20 may be at least partially covered by the top caps 18 as the top caps 18 extend beyond the inner surface 12B of the support wall 12. The pool liner support member 20 may include a bead 30 in which a portion of the pool liner 14 is inserted in order to affix and support the pool liner 14 relative to the support wall 12. The bead 30 may be subsequently crimped or bent upwardly to better affix and seal the pool liner 14. The pool liner support member 20 may be connected to the support wall 12 by adhesives and/or fasteners 32, such as screws. The pool liner support member 20 may be composed of any desired material, such as a plastic, composite, or metal material. For example, the pool liner support member 20 may be composed of aluminum or an aluminum alloy.

Referring now collectively to FIGS. 5A-5B and FIGS. 1-4, there is shown in greater detail the top cap 18 (FIG. 5A)

and the filler strip or insert 22 (FIG. 5B) of the present invention. Each top cap 18 may have a channel 34 located substantially in the middle of the peripheral surface 24B, which extends the length of the shell body 24, and is configured for receiving the insert 22. The channel 34 may have an upper portion 34A and a lower portion 34B. The upper portion 34A has a wider opening than the lower portion 34B. The lower portion 34B of the channel 34 may have one or more notche(s) 36, such as two notches 36, which extend the length of the channel 34. The notches 36 can have any desired shape such as an angular indent, a triangular cross-section, a semi-circular cross-section, etc. The insert 22 that has an upper portion 22A and a lower portion 22B which respectively correspond with the upper and lower portions 34A, 34B of the channel 34. Additionally, the lower portion 22B of the insert 22 has one or more protrusion(s) 38, such as two protrusions 38, that extend the length of the insert 22 and correspond with the notches 36 of the bottom portion 34B of the channel 34. The protrusions 38 of the insert 22 may substantially fit within the notches 36 of the channel 34. When the insert 22 is positioned within the channel 34 of the top cap 18, the top surface of the insert 22 is flush and follows the curvature of the peripheral surface 24B of the shell body 24 of the top cap 18. It should be appreciated that the top caps 18, as well as the inserts 22, can provide structural support to the support wall 12. The inserts 22 may be fitted in the channels 34 at straight and/or curved portions of the top caps 18. However, it is noted that the reinforcing system 16 may not include an insert 22, and thereby the shell body 24 may or may not include a channel 34.

Figure 6A:
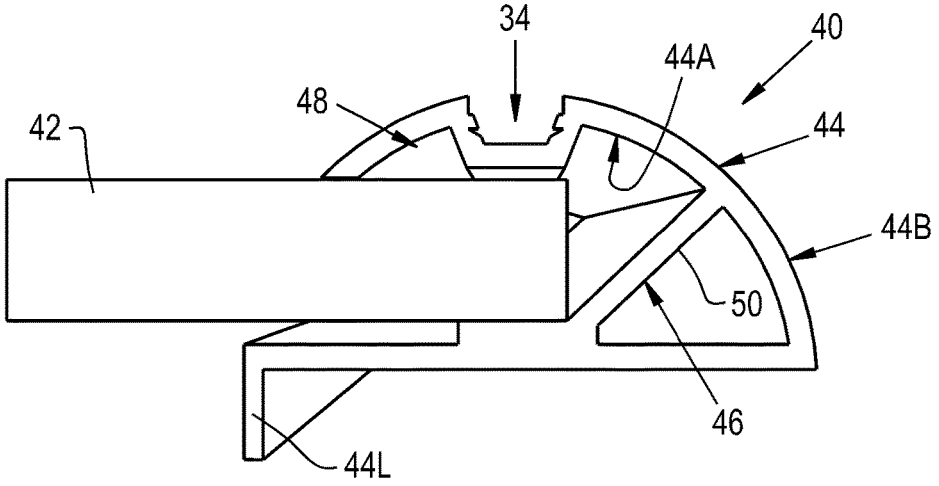
FIG. 6A is a side view of another embodiment of a top cap with a profile to accommodate a deck according to the present invention.
Figure 6B:
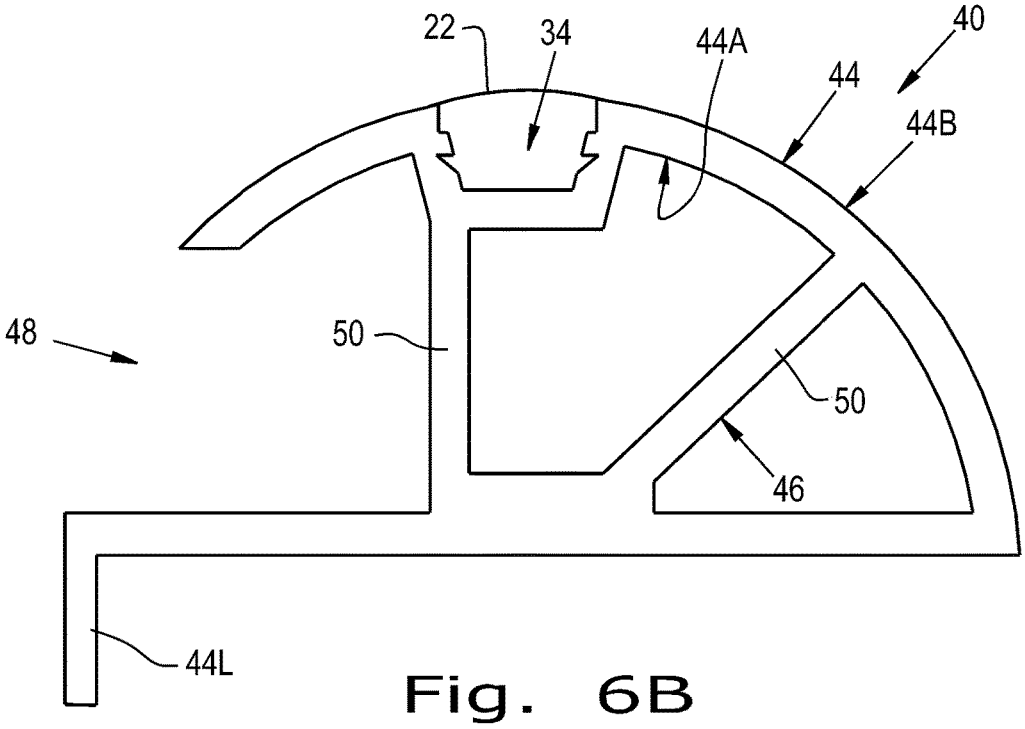
FIG. 6B is a side view of the embodiment of the top cap as shown in FIG. 6A.

Referring now FIGS. 6A-6B, there is shown another embodiment of a top cap 40 that can accommodate a flooring 42, such as a deck. The top cap 40 may be designed as the top cap 18, but for the distinctions in the shell body 44 of the top cap 40 which enable the flooring 42 to be at least partially housed within a portion of the top cap 40. The shell body 44 generally includes an inner surface 44A, a peripheral surface 44B, an outer lip portion 44L, and an internal truss structure 46.

The peripheral surface 44B of the shell body 44 has an opening 48 formed therein for receiving at least a portion of the flooring 42. The opening 48 may be in the form of a cutout or a slot which is wide enough for the flooring 42 to fit therethrough. The opening 48 may extend along a part of or along the full length of the top cap 40. Additionally, there may be one or multiple opening(s) 48 within the top cap 40. As shown, the opening 48 is located at the outwardly facing region of the peripheral surface 44B, and the opening 48 extends from bottom of the shell body 44 to the channel 34. The opening 48, however, may be smaller such that the opening 48 does not extend up to the channel 34.

The internal truss structure 46, in the region of the opening 48, may include a single truss or rib member 50. This way, the flooring 42 may extend inwardly, from left to right as shown in FIG. 6A, into the top cap 40. The flooring 42 may extend at least partially within the top cap 40, or the flooring 42 may fit such that the flooring 42 rests more than halfway into the top cap 40, up to the single truss member 50. In a region of the shell body 44 which does not include an opening 48, the shell body 44 may include more than one truss member 50, such as two truss members 50 (FIG. 6B).

Figure 7:
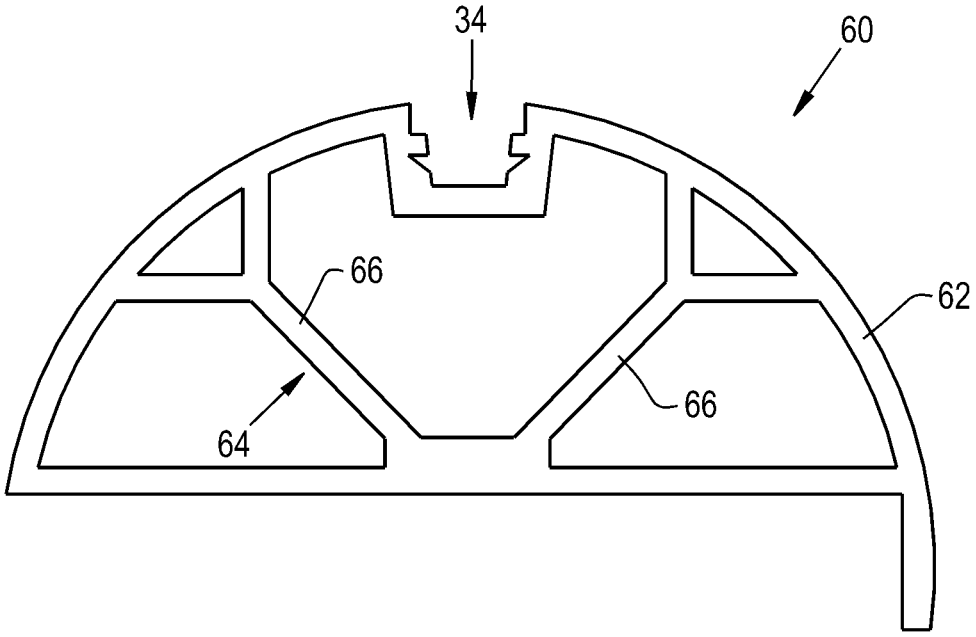
FIG. 7 is a side view of another embodiment of a top cap according to the present invention.

Referring now to FIG. 7, there is shown another embodiment of a top cap 60 according to the present invention in which the shell body 62 includes another possible form of an internal truss structure 64. The top cap 60 may be designed as the top caps 18, 40 except for the internal truss structure 64. The internal truss structure 64 of the top cap 60 includes at least one truss member 66 which has a "Y" cross-section. The Y-shaped truss member 66 may extend from the center of the shell body 62, outwardly at approximately 45 degrees, to the edge of the shell body 62. It should be appreciated however that other cross-sectional shapes, e.g. a "V" cross-section, and various orientations, e.g. 5-80 degrees, of the truss member 66 are conceivable.

Figure 4:
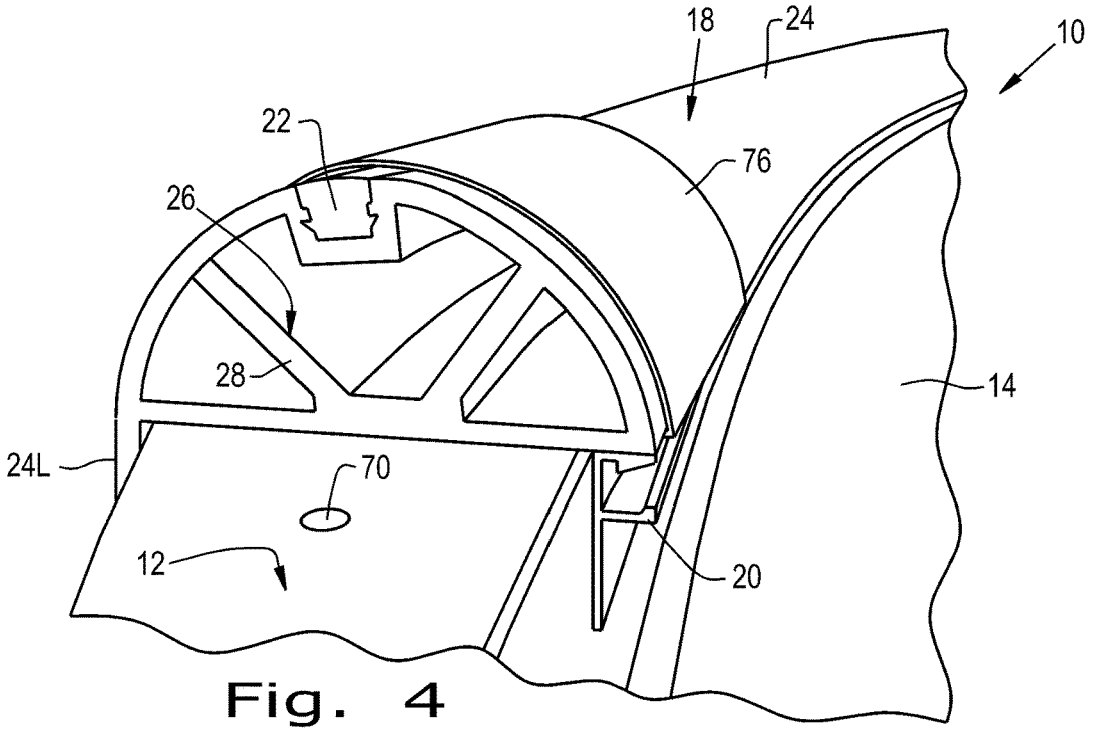
FIG. 4 is a perspective view of the end of the top cap and a pool liner support member coupled to the inner wall of the retaining wall of the pool.

The method of installing the top caps 18, 40, 60 of the present invention may include the following steps. For brevity of description, the method is described with respect to the embodiment of the top caps 18 as described above. Initially, holes 72 may be drilled in the top caps 18. For example, a first set of holes 72 may be drilled through the bottom surface of the channel 34. Thereby, fasteners 74, such as bolts or self-tapping screws, may be inserted through the holes 72 and screwed through the bottom surface of the shell body 24 to affix the top cap 18 to the top flange 12A. It should be appreciated that a second set of corresponding holes may or may not be drilled through the bottom surface of the shell body 24 (not shown). Further, it should be appreciated that the top flange 12A may or may not have holes 70, which may be drilled in the top flange 12A of the support wall 12 in order to receive the fasteners 74 (FIGS. 3-4). It is possible that the holes 72 in the top caps 18 can be initially molded into the shell bodies 24 during initial fabrication of the top caps 18. Also, in an alternative embodiment, the shell body 24 may not include any holes in the channel 34 or the bottom surface of the shell body (not shown). To install the top caps 18, the top caps 18 may be placed on the support wall 12, and the top caps 18 may be flexed, e.g. laterally bent, to follow the profile of the support wall 12. For instance, if the support wall 12 has a curved portion, then the top caps 18 may be bent to follow the curvature of the support wall 12. An individual installing the top caps 18 may pull laterally on the top cap 18 to flex the top cap 18 to an extent such that the outer lip portion 24L abuts against the outside of support wall 12, and may then insert a self-tapping screw 74 to affix the top cap 18 to the top flange 12A. This bending and screwing process is repeated to match the shape of the top cap 18 to the bent support wall 12. In straight portions of support wall 12, the top cap 18 is simply not bent and just screwed to the top end 12A of the support wall 12. Hence, the top caps 18 may be rigidly attached to the support wall 12. In this regard, to create a more aesthetically pleasing surface by covering the holes 72, the inserts 22 may be inserted into the channel 34. For example, the inserts 22 may be tapped in by a rubber mallet until the protrusions 38 fit within the notches 36 of the shell body 24. It is conceivable, however, that the inserts 22 may not be inserted into the channels 34. To connect one end of a first top cap 18 to an adjacent end of a second top cap 18, a clip 76 may be fitted over the top of both ends of the adjoining top caps 18. The clip 76 may have lip portions on each end which snap into place around the edges of the top caps 18 as the clip 76 is coupled to the adjoining ends of the top caps 18. The clip 76 may be composed of any desired material, such as a plastic, composite, or metal material. In the illustrated embodiment, the clip 76 is composed of an aluminum material which is preformed to match the contour of the top caps 18. Once the clip 76 is fitted onto the top caps 18, the assembly may be completed. Therefore, the top caps 18 are sufficiently flexible to match the design of the support wall 12 and provide sufficient support to the support wall 12 such that the top caps 18 do not collapse under a downward acting force exerted on the top caps 18.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A pool, comprising:

a wall having a top end and a wall profile; and a reinforcing system for reinforcing the wall and including:

a plurality of top caps attached to the top end of the wall, each said top cap including a shell body with a peripheral surface, a bottom, and at least one internal truss member such that each said top cap is laterally flexible, and said shell body further including a channel located in the peripheral surface, said channel including a channel bottom with at least one hole therein such that at least one fastener is inserted through said at least one hole in the channel bottom to fasten the bottom of said top cap to the top end of said wall; and at least one insert received within said channel and covering said at least one hole in the channel bottom.

2. The pool of claim 1, wherein each said top cap is composed of a semi-deformable material such that each said top cap is both laterally flexible for following the wall profile and non-collapsible for reinforcing the wall.

3. The pool of claim 2, wherein said semi-deformable material is in the form of at least one of a plastic material and a composite material.

4. The pool of claim 3, wherein said semi-deformable material is in the form of said plastic material with a durometer of 95±3.

5. The pool of claim 1, wherein said reinforcing system further includes a pool liner support member attached to an inner surface of the wall and at least partially covered by said plurality of top caps, said pool liner support member is configured for attaching and supporting a pool liner of the pool.

6. The pool of claim 1, wherein a first width of the shell body and a second width of said at least one internal truss member are each between 0.0625-0.25 inches.

7. The pool of claim 1, wherein said channel has an upper portion and a lower portion with at least one notch such that said upper portion has a wider opening than said lower portion, and said at least one insert has an upper portion and a lower portion with at least one protrusion which corresponds with said at least one notch of the lower portion of the channel.

8. The pool of claim 1, wherein said peripheral surface of the shell body has an opening formed therein which is configured for receiving a portion of a flooring.

9. The pool of claim 1, wherein each said top cap further includes an outer lip portion extending below the top end of the wall and adjacent to an outer surface of the wall.

10. A reinforcing system for a pool having a wall with a top end and a wall profile, comprising:

a plurality of top caps attached to the top end of the wall, each said top cap including a shell body with a peripheral surface, a bottom, and at least one internal truss member such that each said top cap is laterally flexible, and said shell body further including a channel located in the peripheral surface, said channel including a channel bottom with at least one hole therein such that at least one fastener is inserted through said at least one hole in the channel bottom and said at least one fastener is configured for fastening the bottom of said top cap to the top end of said wall; and at least one insert received within said channel and covering said at least one hole in the channel bottom.

11. The reinforcing system of claim 10, wherein each said top cap is composed of a semi-deformable material such that each said top cap is both laterally flexible for following the wall profile and non-collapsible for reinforcing the wall.

12. The reinforcing system of claim 11, wherein said semi-deformable material is in the form of at least one of a plastic material and a composite material.

13. The reinforcing system of claim 10, wherein said reinforcing system further includes a pool liner support member at least partially covered by said plurality of top caps and configured for attaching to an inner surface of the wall and for attaching and supporting a pool liner of the pool.

14. The reinforcing system of claim 10, wherein said at least one internal truss member is in the form of a pair of truss members disposed within said shell body.

15. The reinforcing system of claim 10, wherein said channel has an upper portion and a lower portion with at least one notch such that said upper portion has a wider opening than said lower portion, and said at least one insert has an upper portion and a lower portion with at least one protrusion which corresponds with said at least one notch of the lower portion of the channel.

16. The reinforcing system of claim 10, wherein said peripheral surface of the shell body has an opening formed therein which is configured for receiving a portion of a flooring.

17. The reinforcing system of claim 10, wherein each said top cap further includes an outer lip portion extending below the top end of the wall and adjacent to an outer surface of the wall.

18. A method for reinforcing a pool with a wall having a top end and a wall profile, comprising the steps of:

providing a reinforcing system configured for reinforcing the wall, said reinforcing system including a plurality of top caps configured for attaching to the top end of the wall, each said top cap including a shell body with a peripheral surface, a bottom, and at least one internal truss member such that each said top cap is laterally flexible, and said shell body further including a channel located in the peripheral surface, said channel including a channel bottom with at least one hole therein and at least one insert configured to be received within said channel;

flexing at least one top cap of said plurality of top caps for following the wall profile of the wall;

attaching said plurality of top caps to the wall of the pool by inserting at least one fastener through said at least one hole in the channel bottom to fasten the bottom of said top cap to the top end of said wall; and inserting said at least one insert within said channel for covering said at least one hole in the channel bottom.

* * * * *